US005513785A

United States Patent [19]

Campagna, Jr.

[11] Patent Number: 5,513,785

[45] Date of Patent: May 7, 1996

[54] GUN RETENTION SYSTEM

[76] Inventor: Gerald P. Campagna, Jr., 100 E. Chicago St., #700, Elgin, Ill. 60120

[21] Appl. No.: 210,948

[22] Filed: Mar. 21, 1994

[51] Int. Cl.[6] ..... F41C 33/00

[52] U.S. Cl. ..... 224/162; 224/912

[58] Field of Search ..... 224/162, 198, 224/911, 912

[56] References Cited

U.S. PATENT DOCUMENTS

| | | | |
|---|---|---|---|
| 723,545 | 3/1903 | Phillips | 224/912 |
| 902,083 | 10/1908 | Hudson | 224/912 |
| 1,566,192 | 12/1925 | Forrest . | |
| 1,675,072 | 6/1928 | Watermon | 224/162 |
| 2,764,326 | 9/1956 | Stanton . | |
| 2,812,124 | 11/1957 | Werbner . | |
| 3,124,286 | 3/1964 | Dompier . | |
| 3,258,182 | 6/1966 | McDonald . | |
| 3,289,903 | 12/1966 | Taormina . | |
| 3,317,098 | 5/1967 | Auraen . | |
| 3,908,875 | 9/1975 | Wilson et al. . | |
| 4,877,167 | 10/1989 | McNemar . | |
| 5,009,022 | 4/1991 | McCoy | 42/94 |
| 5,124,685 | 6/1992 | Rankin . | |

FOREIGN PATENT DOCUMENTS

| | | | |
|---|---|---|---|
| 2535040 | 4/1984 | France | 224/162 |

*Primary Examiner*—Renee S. Luebke
*Attorney, Agent, or Firm*—Patula & Associates

[57] ABSTRACT

A gun retention system is provided for an officer to securely lock his weapon inside his holster while at the same time allowing quick and easy drawing of the weapon and maintaining a physical connection between the weapon and the officer's security belt. The gun retention system comprises a weapon grip, a security belt, and a spool housing. The weapon grip contains a connector which attaches to the security belt and can be either right-handed or left-handed. The other end of security belt is connected to a spool and is coiled around the spool inside the spool housing. The spool housing can be mounted on the service belt directly behind an existing holder or can be integrally attached to a holster. A spool lock button on the spool housing provides safe and quick locking and unlocking of the gun inside the holster. The security belt does not interfere with the officer's ability to load, draw, aim and fire his weapon when needed. Tension in the security belt can be adjusted to the officer's desire.

18 Claims, 2 Drawing Sheets

FIG. 5
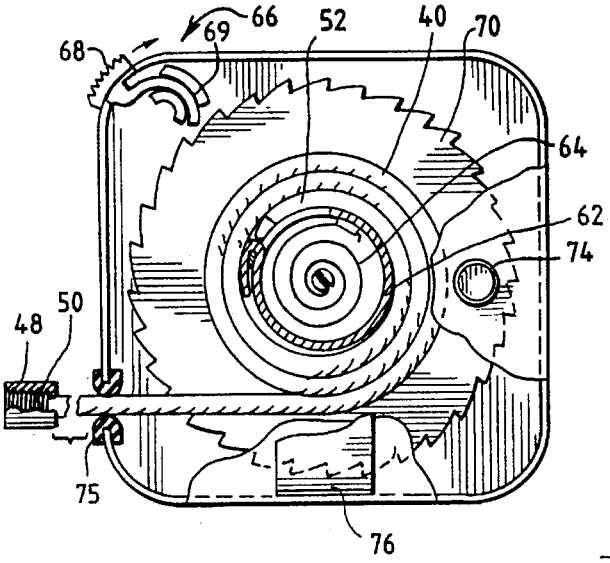
FIG. 6
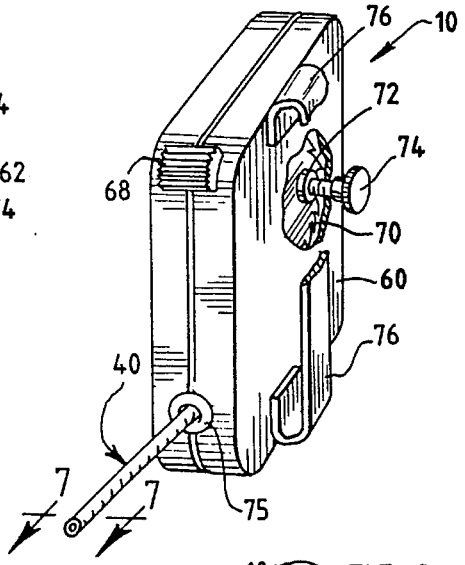
FIG. 7
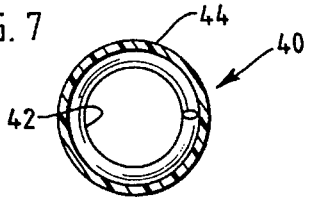
FIG. 9
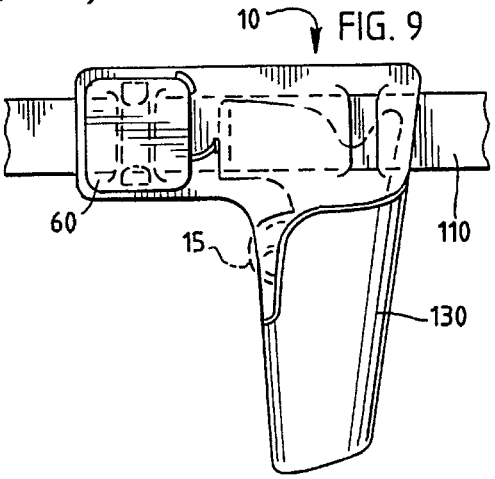
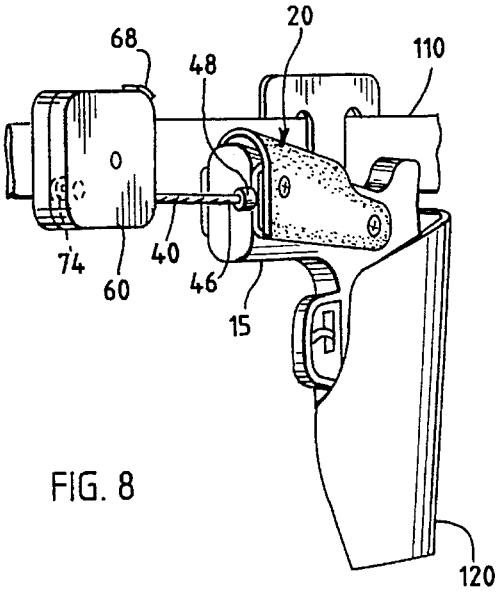
FIG. 8
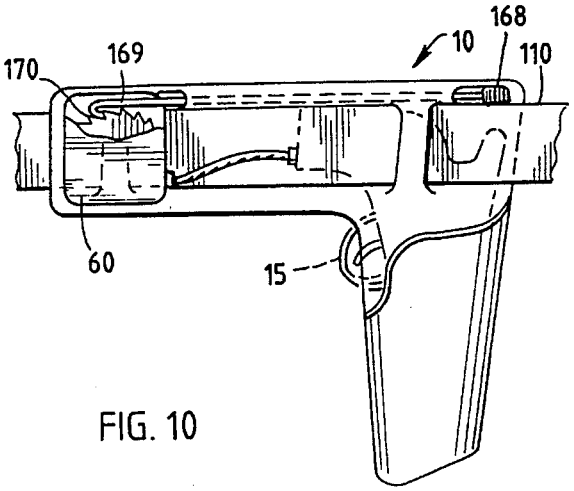
FIG. 10

GUN RETENTION SYSTEM

The present invention relates to guns and, in particular, a gun retention system, specifically a system for attaching a gun to a duty belt of an officer.

BACKGROUND OF THE INVENTION

It is a tragic fact that a large percentage of law enforcement officers who are shot in the line of duty are shot with their own gun. At least 100 officers died in the past decade because their weapons were seized by a suspect and fired upon while in the line of duty. Undoubtedly, the number of officers wounded in a similar fashion is much higher. In many cases, it is the officer who is bringing the weapon into the situation, for example, a domestic violence situation. In this case, the officer must divide his attention between the situation at hand as well as taking precautions to guard against one of the parties reaching for his weapon. All too often this provides too great a task for the officer.

Present systems in use by an officer to avoid such a situation are inadequate and fail much too often. For example, the gun strap of a holster is simple and quick to use, however, it does not provide enough protection to prevent the officer's gun from being removed involuntarily. Other locking devices in a holster are too time-consuming and difficult to use and often put the officer at risk of not being able to draw his weapon fast enough.

U.S. Pat. No. 3,289,903 issued to Taormina, discloses a safety gun holster in which a pair of handcuffs are inserted through a hole in the holster to lock the gun and prevent the gun from being fired. However, this system is time-consuming to lock and unlock and would cause great delays in the officer drawing his gun in the field.

U.S. Pat. No. 2,764,326 issued to Stanton, discloses a pistol carrying means wherein the barrel of a gun is inserted around a rod attached to a sling. Stanton's pistol carrying means in no way prevents a gun from being drawn and used against the officer.

U.S. Pat. No. 3,258,182 issued to McDonald, discloses a combination gun carrying harness and flexible sling. McDonald's harness and sling is for use by hunters carrying a rifle or shotgun. McDonald's carrying harness is unapplicable to hand guns and provides no security means for a hand gun in a holster.

U.S. Pat. No. 5,124,685 issued to Rankin, discloses a security device with retractable tether for deterring theft of articles of merchandise openly displayed for customer handling and demonstration. Rankin's device lacks a locking mechanism, is wholly unrelated to guns, and neither suggests nor discloses the use in combination with a gun.

Accordingly, there is a need for a gun retention system which securely locks the gun of a law enforcement officer inside the holster on his duty belt while at the same time being quick and easy to unlock and provides for fast and uninhibited drawing of the gun from the holster. Further, there is a need for the gun retention system to have the gun attached to the officer's duty belt at all times to prevent the gun from being removed or taken away from the officer in order to be used on the officer or on other people at a later time.

SUMMARY OF THE INVENTION

The present invention comprises three major components: a weapon grip, a security belt, and a security belt spool housing. The security belt spool housing comprises a flat metal case which slides onto the officer's existing duty belt and is positioned directly behind the gun and holster. Inside the security belt spool housing is a retractable spring loaded spool around which the security belt is coiled and uncoiled. On top of the belt housing is a slidable button which locks the spool in place and prevents the security belt from uncoiling. The belt housing further includes a tension control for the spool.

The security belt comprises a metal coil surrounded by a nylon sheath in order to prevent corrosion. One end of the belt is attached to the spool inside the belt spool housing, the other end of the belt is attached to the weapon grip via a threaded metal bolt. The weapon grip is a replacement gun grip which comes in a variety of configurations depending on the type of weapon that is going to be utilized with the present invention.

A metal mounting bracket molded into the gun grip includes a threaded metal receiver which protrudes from the butt of the weapon so that the security belt can be threaded onto the weapon.

When the present invention is utilized, the officer using the system can lock the gun into his holster simply by sliding the button on top of the belt spool housing. In order to draw the weapon from his holster, the officer simply has to slide the belt or spool lock button to the free position and remove his weapon from the holster. The weapon is still attached to the belt so that if someone were to try to wrestle the gun away, the weapon could still not be removed from the officer.

In an alternate embodiment, the spool housing is formed integrally with a holster. In this embodiment, the belt or spool lock button is positioned at the front of the holster, and is operatively connected with the spool housing located at the back of the holster.

Accordingly, it is the principle object of the present invention to provide a means for securing a gun to an officer's duty belt.

It is a further object of the present invention to provide a gun retention system for selectively locking a gun into an officer's gun holster.

It is also an object of the present invention to provide for a quick and easy security device which allows an officer to quickly draw his weapon in an uninhibited manner.

It is an additional object of the present invention to provide a simple and novel method of securing an officer's weapon to his duty belt.

It is yet another object of the present invention to provide a means for attaching an officer's weapon to his or her duty belt without substantially affecting the officer's ability to draw the weapon on demand.

Numerous other advantages and features of the present invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to the accompanying drawings wherein:

FIG. 5 is a partially broken-away side elevational view of the spool housing and spool;

FIG. 6 is a back perspective view of the spool housing;

FIG. 7 is a cross-sectional view of the security belt;

FIG. 8 is a perspective view of the present invention in use with an existing holster;

FIG. 9 is a front-elevational view of an alternate embodiment of the present invention; and FIG. 10 is a front-elevational view of another alternate embodiment of the present invention.

DETAILED DESCRIPTION OF THE PREFERRED EMBODIMENT OF THE PRESENT INVENTION

Preferred Embodiment of the Present Invention

Figure 1:
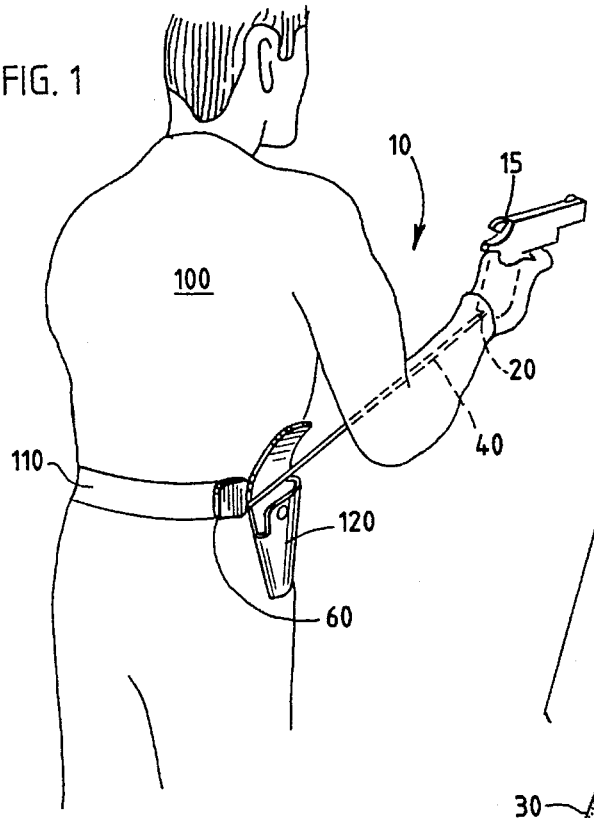
FIG. 1 is a perspective view of the preferred embodiment of the present invention in use.

While the invention is susceptible of embodiment in many different forms, there is shown in the drawings and will be described herein in detail, a preferred and alternate embodiment of the invention. It should be understood however that the present disclosure is to be considered an exemplification of the principles of the invention and is not intended to limit the spirit and scope of the invention and/or claims of the embodiment illustrated.

FIGS. 1–8 illustrate generally the present invention 10 comprising weapon grip 20, security belt 40, and belt housing 60. Weapon grip 20 comprises left side gun panel 22, left metal mounting bracket 24, right side gun panel 26, right metal mounting bracket 28, and rubber grip connector 30. Integrally formed at a bottom end of the left metal mounting bracket or the right metal mounting bracket is belt connector 35 having threads 37. Security belt 40 comprises a steel cable 42 surrounded by a nylon sheath 44. The gun end 46 of security belt 40 includes a connector 48 having internal threads 50 which connects to connector 35 of weapon grip 20. Spool end 52 of security belt 40 connects to the spool inside spool housing 60. Spool housing 60 comprises a retraction or recoil spool 62 having a spring 64. Spool housing 60 further comprises a spool lock 66 activated by a spool lock button 68 which is surrounded by seals. A friction pad 72 operatively connected to a friction control 74 adjusts the tension of the spool.

FIGS. 9 and 10 illustrate alternate embodiments of the invention 10 wherein the spool housing 60 is formed integral with and mounted on a holster 130 having an elongated upper belt attachment portion. In the embodiment shown in FIG. 9, the spool lock mechanism is the same as in FIGS. 1–8. In the embodiment of FIG. 10, spool lock button 168 is placed in the front of the holster and is operatively connected to the spool housing 60 which is located in the back of the holster 130.

Referring now specifically to the drawings, FIG. 1 illustrates the present invention 10 in use by a law enforcement officer 100. As can be seen, weapon grip 20 attached to gun 15 is connected to the security belt 40 at the gun end 46 of belt 40. Spool end 52 of security belt 40 is attached inside spool housing 60 which is secured on the officer's duty belt 110. As can be seen, gun 15 can easily be removed or drawn from holster 120 without interference by security belt 40. Spool tension can be adjusted to each individual law enforcement officer's preference.

Figure 2:
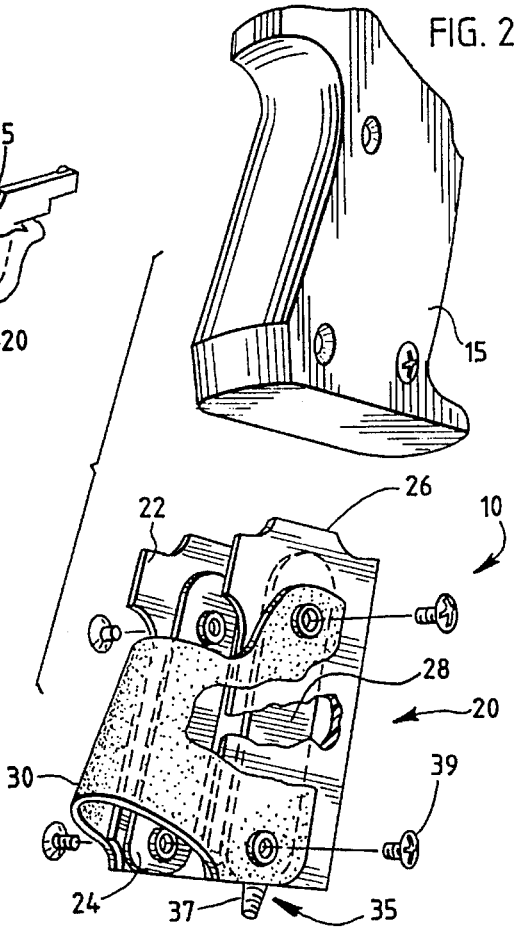
FIG. 2 is a exploded view of a gun handle and the gun grip and of the present invention.

FIG. 2 shows an exploded view of the handle of gun 15 wherein weapon grip 20 is seen comprising left side panel 22 having left metal mounting bracket 24 therein, right side panel 26 having right metal mounting bracket 28 therein, and rubber grip 30 which surrounds the handle of the gun and connects left side panel 22 with the right side panel 26. Gun grip 20 is mounted to the gun handle via suitable fastener 39. Weapon grip 20 can be manufactured on gun 15 originally or can be used as a replacement grip on a gun presently being used by an officer.

Right metal mounting bracket 28 includes an integrally formed belt connector 35 having threads 37 thereon. Belt connector 35 extends beyond the butt of gun 15.

Figure 3:
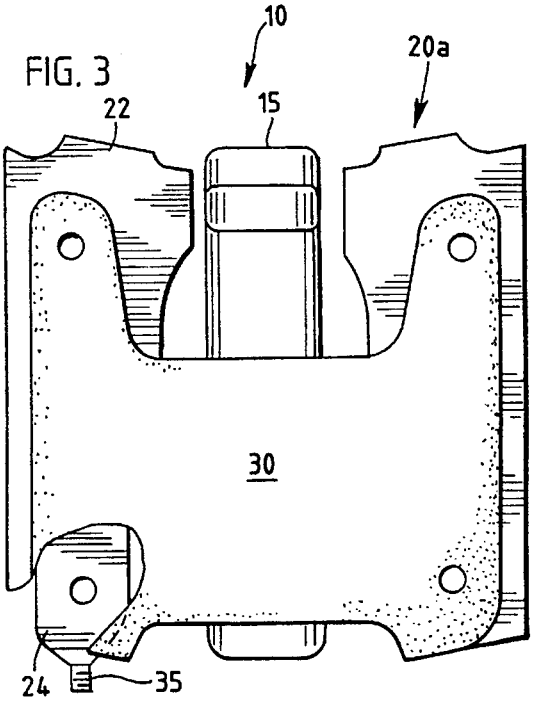
FIG. 3 is a front view of an unattached left-handed metal mounting bracket as seen from the back of a gun handle.

FIG. 3 illustrates a left-handed weapon grip **20*a* wherein the left metal mounting bracket 24 includes connector 35. Weapon grip 20*a* is shown in reference to the back of the handle of gun 15, unattached or flattened out wherein side panels 22 and 26 need only to be wrapped around to their respective sides of the gun handle and fastened in order to be attached. An officer who is left handed and carries his gun on his left hand side preferably wants connector 35 to be on the outside of the gun so that belt 40** does not interfere in any way with the officer's ability to draw or load his weapon.

Figure 4:
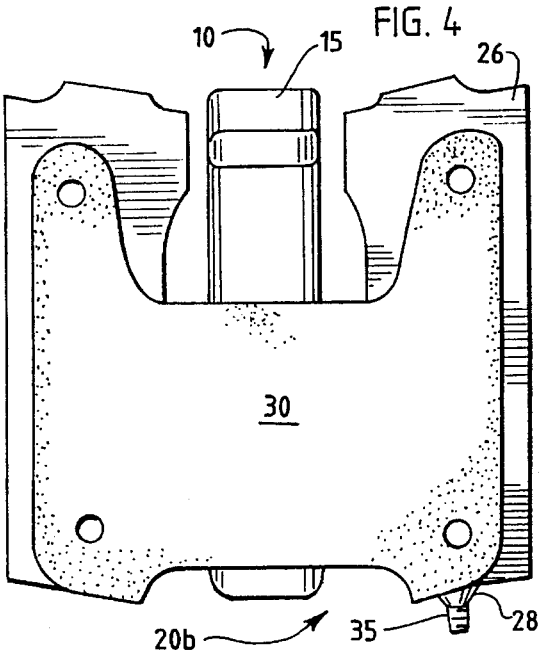
FIG. 4 is a front view of an unattached right-handed metal mounting bracket as seen from the back of a gun handle.

Similarly, FIG. 4 shows weapon grip **20*b* with right-handed metal mounting bracket 28 integrally formed with connector 35. Weapon grip 20*b* is shown in reference to the back of the handle of gun 15, unattached or flattened out wherein side panels 22 and 26 need only to be wrapped around to their respective sides of the gun handle and fastened in order to be attached. A right-handed officer who carries his gun on his right side has the connector 35 on the outside of his weapon so that no interference with belt 40** occurs during the removal of his weapon from the holster.

FIG. 5 illustrates spool housing 60 wherein security belt 40 coils around spool 62. Spool 62 is a retractable spring loaded spool in which spring 64 continually biases spool 62 to coil belt 40 when belt 40 has been uncoiled from spool 62. Belt 40 is seen having a connector 48 at its gun end 46 which complementarily connects with connector 35 of gun grip 20.

Also seen in FIG. 5 is spool lock mechanism 66 which prevents the rotation of spool 62 upon sliding the spool lock button 68 backwards away from the gun and holster, into its locking position. Spool lock button 68 is preferably surrounded by a water-proof seal so that no moisture can enter spool housing 60 through the slot for spool lock button 68. Spool lock button 68 operates a pawl 69 which engages a ratchet 70 mounted to spool 62 to selectively lock and unlock spool 62. It should be understood however that any suitable spool locking means could be utilized with the present invention.

FIG. 5 further illustrates tension control means comprising friction pad 72 (FIG. 6) which is adjustable by friction control knob 74 to selectively adjust friction pad 72 (FIG. 6) in contact with ratchet 70, to selectively adjust the retraction force of the spool.

FIG. 6 shows a back perspective view of spool housing 60. Spool housing 60 includes a metal belt loop 76 through which the law enforcement officer's duty belt is passed to securely mount spool housing 60 to the officer's service belt 110. Belt loop 76 is strong enough to prevent spool housing 60 from being unwantedly detached from the service belt 110.

Also seen in FIG. 6 is spool lock button 68 and tension control dial 74. Tension control dial 74 is rotated to adjust the spool tension and is preferably set into a depression in spool lock housing 60 such that the tension of the spool cannot be unintentionally adjusted by movement against a law enforcement officer. Tension control knob 74 is preferably on the belt loop side of the spool housing so that the tension control knob cannot be rotated unintentionally. The spool housing can be manufacture left-handed or right-handed to mount on the respective side of the officer's service belt, according to preference.

FIG. 7 shows a cross-sectional view of security belt 40. Security belt 40 comprises a durable steel cable 42 surrounded by a water-proof nylon sheath 44. Security belt 40 is strong enough to prevent gun 15 from being detached from spool housing 60.

FIG. 8 shows the present invention 10 wherein gun 15 is secured and locked inside an existing holster 120 on an officer's service belt 110. Spool lock button 68 has been moved into its locking position such that spool 62 will not rotate. Thus, security belt 40 is prevented from uncoiling. Security belt 40 is attached at gun end 46 to connector 35 of weapon grip 20. Security belt 40 further extends inside spool housing 60 through housing aperture 75 (see FIGS. 5 and 6).

FIG. 9 illustrates an alternate embodiment of invention 10 in use with gun 15 wherein spool housing 60 is integrally formed with holster 130 on the officer's duty belt 110. In this embodiment, spool housing 60 always remains in the same location relative to the gun holster such that movement by the officer cannot move the placement of the spool housing, thereby facilitating the timing of the officer in drawing his weapon.

FIG. 10 illustrates another embodiment of the present invention wherein the spool housing 60 is integral with holster 130. However, in this embodiment, spool lock button 168 is slidably mounted in a front, upper portion of the holster 130, remote from the spool housing. Sliding spool lock button 168 operatively engages and disengages locking bar 169 with ratchet 170 to selectively lock and unlock spool 62. Locking bar 169 is slidably mounted in holster 130, and includes a C-shaped end portion to engage the ratchet. Having the spool lock button at the front of the holster will allow a user to selectively lock and unlock the spool with more speed and ease. Besides the advantage to the user, the front holster spool lock button will make it much more difficult for an intervening third party to unlock the spool. It will be harder for this third party to ascertain the location of the button and to realize what this button does, since it is separated a distance from the spool housing. In this embodiment, the C-shaped end portion of the locking bar engages the ratchet and locks the spool when the spool lock button is slid forward, away from the gun. To unlock the spool and draw the gun, the user need simply in one motion to slide the spool lock button back and grasp and draw the gun. With the present invention in use, a traditional holster strap is not needed and is replaced by the spool lock of the present invention.

To use the present invention, an officer simply obtains a weapon including weapon grip 20 as original equipment thereon or simply removes the existing gun grip and attaches the weapon grip 20 as a replacement. Once this is done, the spool housing 60 is attached to the officer's service belt directly behind the holster if not integral with the holster. Security belt 40 is then attached to connector 35 of weapon grip 20 and gun 15 is placed inside holster 120. To prevent the gun from being removed from the holster, the officer simply need slide the spool lock button 68 backwards into its locking position, or button 168 forward into its locking position in the alternate embodiment. The gun is thus securely locked inside holster 120 and cannot be removed simply by grabbing the weapon itself. In order to draw the weapon from its holster, the law enforcement officer simply, in one motion, has to slide the spool lock button 68 forward, or button 168 backward, to the unlocked spool position and remove his weapon from the holster. The weapon is still attached to the belt so that if someone were to try to wrestle the gun away, the weapon still could not be removed from the officer.

The configuration of the gun retention system allows for existing holsters to still be utilized, as the connector 48 of belt 40 is attached to the butt of the gun which remains free of the holster. However, because the weapon is physically attached to the officer's duty belt, it can be locked in place via the spool lock button. The holster retaining strap or straps on an existing holster do not need to be engaged. Through proper training, this would permit an officer to withdraw a weapon quicker than was previously possible with conventional holster retention systems and at the same time provide greater safety. This would greatly reduce the risk of law enforcement officers and innocent civilians being shot by a third party with the officer's weapon by attaching the officer's weapon to his duty belt without substantially affecting the officer's ability to draw, aim and fire his weapon when necessary. The retraction force in the spool is adjustable according to the officer's desire, however there will always be at least a minimum tension in the belt so that the belt remains taunt. This is to ensure that the belt will not slack and tangle with an object the officer may be leaning against or passing.

While the locking mechanism of the present invention has been described with reference to a ratchet and pawl, it is foreseen that any suitable spool locking means could be used in the present invention. Further, while the spool of the present invention is illustrated as being a spring loaded retractable spool, it is foreseen that any suitable retractable spool means could be used in the present invention. Still further, while the connection of the cable to the gun is illustrated as a threaded male bolt/female receiver combination, it should be understood that this connection could be made by any suitable connector means.

It is to be understood that the embodiments herein described are merely illustrative of the principles of the present invention. Various modifications may be made by those skilled in the art without parting from the spirit or scope of the claims which follow.

I claim:

1. A gun retention system for securing a gun having a handle with a butt end to a belt worn around a person's waist, said gun retention system comprising:

a gun retention means mounted on said belt for anchoring said gun to said belt, said gun retention means comprises a retractable spool operatively mounted in a spool housing;

a means for attaching said gun to said gun retention means; and a means, mounted to said gun handle, for connecting said means for attaching to said gun, said means for connecting said means for attaching to said gun is a mounting bracket having a connector extending from said butt end of said handle;

said spool housing includes a means for adjusting retraction force of said spool.

2. The gun retention system of claim 1, wherein said means for attaching includes a gun end having a complimentary connector for connection with said connector of said mounting bracket.

3. The gun retention system of claim 1, wherein said spool is retractable by spring means.

4. The gun retention system of claim 1, wherein said means for adjusting retraction force comprises a friction pad contacting a ratchet connected to said spool, said friction pad being adjustable by a tension control knob mounted in said spool housing.

5. The gun retention system of claim 1, wherein said means for attaching includes a spool end mounted to said spool, said means for attaching being selectively coiled and uncoiled around said spool.

6. The gun retention system of claim 1, wherein said means for attaching said gun to said gun retention means is a cable.

7. The gun retention system of claim 6, wherein said cable is made of steel and is surrounded by a nylon sheath.

8. A gun retention system for securing a gun having a handle with a butt end to a belt worn around a person's waist, said gun retention system comprising:

a gun retention means mounted on said belt for anchoring said gun to said belt, said gun retention means comprises a retractable spool operatively mounted in a spool housing;

a means for attaching said gun to said gun retention means; and a means, mounted to said gun handle, for connecting said means for attaching to said gun, said means for connecting said means for attaching to said gun is a mounting bracket having a connector extending from said butt end of said handle;

said spool housing includes a means for selectively locking said spool, said means for selectively locking said spool is a ratchet and pawl, said ratchet mounted to said spool, said pawl selectively engaging and disengaging said ratchet by a sliding button mounted in said spool housing.

9. A gun retention system for securing a gun having a handle with a butt end to a belt worn around a person's waist, said gun retention system comprising:

a gun retention means mounted on said belt for anchoring said gun to said belt, said gun retention means comprises a retractable spool operatively mounted in a spool housing;

a means for attaching said gun to said gun retention means; and a means, mounted to said gun handle, for connecting said means for attaching to said gun, said means for connecting said means for attaching to said gun is a mounting bracket having a connector extending from said butt end of said handle;

said spool housing includes a means for selectively locking said spool, said means for selectively locking said spool is a ratchet and locking bar, said ratchet mounted to said spool, said locking bar having a C-shaped end portion, said C-shaped end portion selectively engaging and disengaging said ratchet by a sliding button mounted in a remote location from said spool housing.

10. A gun retention system for securing a gun having a handle with a butt end to a belt worn around a person's waist and having a gun holster attached thereto, said gun retention system comprising:

a spool housing mounted on said belt;

a retractable spool operatively mounted in said spool housing;

a cable having a spool end and a gun end, said spool end of said cable being mounted to said spool; and a gun grip mounted to said gun handle, said gun end of said cable being attached to said gun grip, said gun grip comprises a mounting bracket mounted on a side of said gun handle, said mounting bracket including a connector extending beyond the butt end of the gun handle;

said gun grip comprises a left handle side mounting bracket and a right handle side mounting bracket, at least one of said left handle side mounting bracket and said right handle side mounting bracket having a connector extending beyond said butt end of said gun handle.

11. The gun retention system of claim 10, wherein said left and right handle side mounting brackets are mounted in a gun side panel and mounted to said gun handle by a means for fastening.

12. A gun retention system for securing a gun having a handle with a butt end to a belt worn around a person's waist and having a gun holster attached thereto, said gun retention system comprising:

a spool housing mounted on said belt;

a retractable spool operatively mounted in said spool housing;

a cable having a spool end and a gun end, said spool end of said cable being mounted to said spool; and a gun grip mounted to said gun handle, said gun end of said cable being attached to said gun grip, said gun grip comprises a mounting bracket mounted on a side of said gun handle, said mounting bracket including a connector extending beyond the butt end of the gun handle;

said spool housing includes a means for adjusting retraction force of said spool.

13. The gun retention system of claim 12, wherein said gun end of said cable includes a complimentary connector for connection with said connector of said mounting bracket.

14. The gun retention system of claim 12, wherein said mounting bracket is mounted in a gun handle side panel and mounted to said gun handle by a means for fastening.

15. The gun retention system of claim 12, wherein said cable is made of steel and is surrounded by a nylon sheath.

16. The gun retention system of claim 12, wherein said spool housing includes a means for selectively locking said spool.

17. The gun retention system of claim 12, wherein said spool housing includes a belt loop on a back side thereof, said spool housing being mounted on said belt through said belt loop, directly behind said holster.

18. A gun retention system for securing a gun having a handle with a butt end to a belt worn around a person's waist and having a gun holster attached thereto, said gun retention system comprising:

a spool housing mounted on said belt;

a retractable spool operatively mounted in said spool housing;

a cable having a spool end and a gun end, said spool end of said cable being mounted to said spool; and a gun grip mounted to said gun handle, said gun end of said cable being attached to said gun grip, said gun grip comprises a mounting bracket mounted on a side of said gun handle, said mounting bracket including a connector extending beyond the butt end of the gun handle;

said holster includes an elongated upper belt attachment portion, said spool housing is mounted in the elongated upper belt attachment portion of said holster and positioned directly behind said butt end of said gun handle.

* * * * *